United States Patent [19]

Clark et al.

[11] Patent Number: 4,952,492

[45] Date of Patent: Aug. 28, 1990

[54] METHOD AND APPARATUS FOR MODULATING A RADIANT INFRARED BURNER

[75] Inventors: Daniel R. Clark, Fayetteville; Ian M. Shapiro, Syracuse; David A. Lindstrand, Minoa, all of N.Y.

[73] Assignee: Carrier Corporation, Syracuse, N.Y.

[21] Appl. No.: 468,445

[22] Filed: Jan. 22, 1990

[51] Int. Cl.[5] ..... F23D 14/00

[52] U.S. Cl. ..... 431/89; 431/328; 431/7; 239/436; 239/452; 239/533.2

[58] Field of Search ..... 431/89, 7, 328, 329; 239/436, 452, 533.2

[56] References Cited

U.S. PATENT DOCUMENTS

| | | | |
|---|---|---|---|
| 2,605,142 | 7/1952 | Gold et al. | 239/533.2 |
| 4,400,152 | 8/1983 | Craig et al. | 431/328 |
| 4,416,619 | 11/1983 | Craig et al. | 431/328 |
| 4,830,651 | 5/1989 | Smith . | |

*Primary Examiner*—Dority Carroll B.

*Attorney, Agent, or Firm*—Charles E. Adams

[57] ABSTRACT

A method and apparatus for modulating the surface area of a radiant infrared burner over which combustion occurs as a function of burner heat output rate. This modulation serves to maintain the heat flux density on the surface of the burner at or near an optimum value over a range of heat output rates. The modulation is effected by means of a piston disposed in the internal cavity of a burner which blocks the passage of combustible gas to areas of the burner downstream of the piston from the gas inlet to the burner. The piston is displaced further downstream with increased gas flow rate resulting in combustion occuring over an increased area of the burner surface as burner heat output rate is increased. In its simplest embodiment, the invention comprises a burner oriented vertically with the combustible gas entering the bottom of the burner and a free piston which floats on the incoming gas stream at a level within the burner which is proportional to the gas flow rate.

8 Claims, 1 Drawing Sheet

METHOD AND APPARATUS FOR MODULATING A RADIANT INFRARED BURNER

BACKGROUND OF THE INVENTION

This invention relates generally to the regulation of combustion in a radiant infrared burner. Radiant burners are used in a variety of applications including space and water heating systems. In particular, the invention relates to a method of modulating the surface area of a radiant burner on which combustion occurs as a function of the heat output rate of the burner and to an apparatus to effect such modulation.

Radiant infrared burners operate most effectively when the heat flux on the surface of the burner is maintained at some optimum level. The value of this optimum heat flux level is a function of the physical configuration of the burner, the materials used in its construction and the type and composition of the combustible gas used as a fuel.

Designers usually plan for the optimum burner surface heat flux level to exist when the burner is operating at or near its maximum rated heat output capacity. Many applications, however, require heat sources that can deliver variable heat output rates. This requirement means that a radiant burner used in such an application will operate at least part of the time at a heat output rate that will result in a surface heat flux level that is at some value less than optimum.

Radiant burner operation generally remains satisfactory even when the surface heat flux level is as low as 50 percent of the optimum value if the proper ratio of fuel gas to combustion air in the combustible gas supplied to the burner is maintained. At still lower surface heat flux levels, however, burner performance is severely degraded, as the burner produces unacceptable levels of carbon monoxide as a combustion product. At very low surface heat flux levels, radiant burners exhibit even more undesirable performance characteristics such as ignition delays and other combustion problems.

In order to adapt a radiant infrared burner for use in an application requiring it to produce a heat output rate that varies over a wide range of values within its design capacity, it is necessary therefore to maintain the heat flux on the surface of the burner at an acceptable level even at a very low relative heat output rate.

SUMMARY OF THE INVENTION

The object of the present invention is to afford a method and apparatus that will maintain the heat flux on the surface of a radiant infrared burner at or near the optimum value over a wide range of burner heat output rates up to and including the maximum design output rate of the burner. In so doing, the invention assures clean, safe and efficient combustion over a wide range of burner heat output rates. The invention achieves this object by modulating the surface area of the burner over which combustion occurs as a function of the rate of flow of the combustible gas supplied to the burner. This form of modulation is equivalent to modulating the surface area as a function of burner heat output for, if the ratio of fuel gas and combustion air in the combustible gas is maintained constant, the rate of flow of combustible gas determines the burner heat output. By varying the surface area of the burner over which combustion occurs as a function of the burner heat output rate, the heat flux on the burner surface can be maintained at or near the optimum value even at rates very much lower than the design capacity of the burner.

The invention is employed in a radiant burner configured to have a gas permeable wall surrounding an elongated central cavity. In such a burner, combustible gas supplied through a gas inlet at one end of the cavity flows through the cavity and the gas permeable wall to the outer surface of the burner where it burns, producing heat. Modulation of the surface area over which there is combustion is accomplished by placing a piston in the central cavity. The piston blocks the flow of combustible gas to the portion of the cavity downstream of the piston from the gas inlet. In this way, combustible gas is prevented from reaching the surface area of the burner outside the downstream portion and combustion does not occur in that area. By changing the position of the piston within the cavity, the surface area of the burner over which combustion occurs can also be changed and modulated so that the heat flux on the burner's outer surface is optimized for any given heat output rate of the burner. Any suitable means of modulation of the piston position may be employed.

The drawings and descriptive matter below describe in detail the advantages of and the object attained by the present invention. The claims which form a part of this specification point out the novel features embodied in the invention.

BRIEF DESCRIPTION OF THE DRAWINGS

The accompanying drawings form a part of the specification. Throughout the various drawings, like reference numbers designate like, corresponding or similar parts.

DESCRIPTION OF THE PREFERRED EMBODIMENTS

Figure 1:
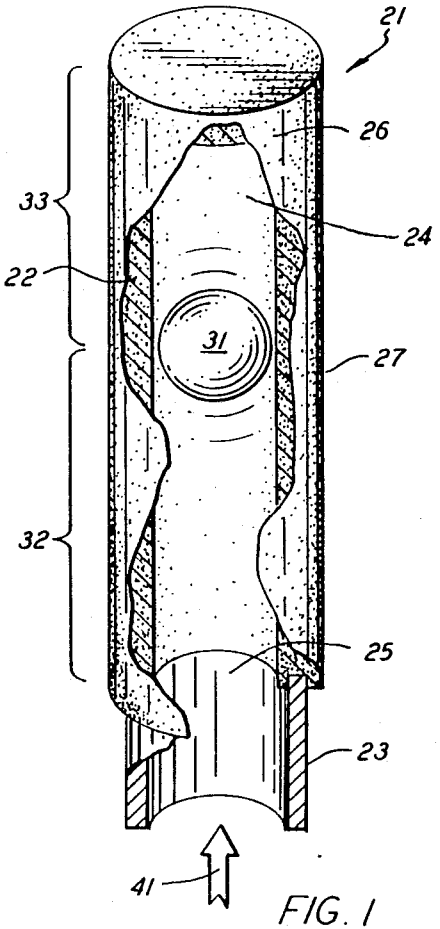
FIG. 1 is a view, partly broken away, of one embodiment of the invention in which the piston freely floats within and over the entire length of the burner central cavity.

FIG. 1 shows a radiant infrared burner 21 operating according to one embodiment of the present invention. Burner 21 is cylindrical in shape and comprises gas permeable wall 22 attached to burner stem 23 and surrounding hollow central cavity 24. Combustible gas 41, comprising a mixture of a gaseous fuel and combustion air, enters central cavity 24 via combustible gas inlet end 25 of burner 21. Opposite end 26 of burner 21 may be either gas permeable or closed to the passage of gas. Spherical gas blocking piston 31, sized to provide a close but free sliding fit with wall 21 floats suspended on the column of combustible gas 41 entering burner 21 at a distance above combustible gas inlet end 26 that is proportional, for reasons that will be explained below, to the volume rate of flow of the incoming combustible gas. Below, but upstream in the combustible gas flow path from gas blocking piston 31, the combustible gas passes through gas permeable wall 22 where it burns on outer surface 27 of the wall. Gas blocking piston 31 prevents the flow of combustible gas 41 to the volume of central cavity 24 above, but downstream in the gas flow path from piston 31, resulting in combustion zone 32 on the outer surface of wall 22 below, and no combustion zone 33 above, the level at which gas blocking piston 31 is floating in central cavity 24.

Figure 2:
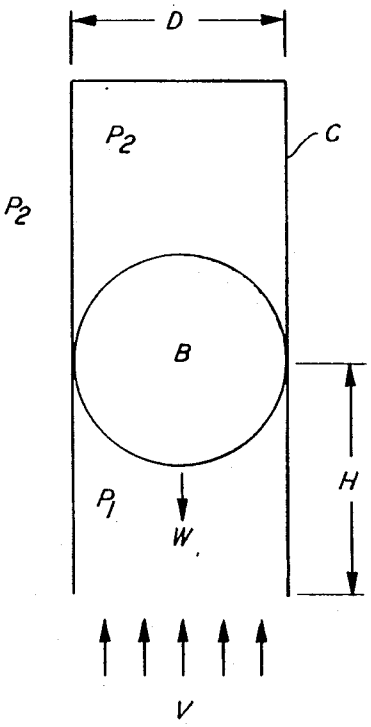
FIG. 2 is a diagram illustrating the principal under which the free floating piston in the embodiment depicted in FIG. 1 acts to maintain the surface area of the burner over which combustion occurs proportional to the heat output rate of the burner.

The principle of operation of the embodiment of the present invention depicted in FIG. 1 is best described and understood in conjunction with FIG. 2. In FIG. 2, spherical body B of weight W and diameter D is freely floating at height H above the bottom of cylinder C, also of diameter D. Cylinder C has gas permeable walls. Body B is suspended on a column of gas flowing into the bottom of cylinder C at pressure $P_1$ and volumetric flow rate V. The pressure in cylinder C above body B is $P_2$, which, because the wall of the cylinder is gas permeable, is the same as the pressure outside the cylinder. Body B has cross sectional area $A_B$ upon which the force of the incoming gas acts. The gas diffuses through the wall of cylinder C over area $A_C$, which is that portion of the wall of cylinder C which is below the diameter of body B.

If the system is in equilibrium, the downward force on body B, or W, is equal to the upward force on body B, which is the differential pressure across the body, $P_1-P_2$, multiplied by the cross sectional area $A_B$ of the body, or $$W = A_B(P_1 - P_2) \text{ and} \quad (1)$$

$$P_1 - P_2 = \frac{W}{A_B}.$$

Also in system equilibrium, the rate at which gas diffuses through the cylinder wall equals the rate at which gas enters the cylinder. The velocity of the gas v′ is equal to the volumetric flow rate V divided by the area of diffusion on wall $A_C$, or:

$$v' = \frac{V}{A_C}. \quad (2)$$

It has been determined that the differential pressure $P_1-P_2$, across the wall is proportional to the velocity of the gas, or $$P_1-P_2=Kv' \quad (3)$$

Since C is a cylinder and B a sphere, $$A_C = \pi DH \text{ and } A_B = \frac{\pi D^2}{4}. \quad (4)$$

Combining expressions (1) through (4), it is seen that $$\frac{4W}{\pi D^2} = \frac{KV}{\pi DH} \text{ and} \quad (5)$$

$$V = \frac{4W}{KD} H.$$

Since the parameters within the parentheses in expression (5) are all constants for a given cylinder and spherical body, it is seen that H is proportional to V, or the height that body B will float above the bottom of cylinder C is proportional to the volumetric rate of flow V of the incoming gas and, as the flow rate of the incoming gas is increased, body B will float at a greater height within cylinder C.

Empirical tests of the embodiment depicted in FIG. 1 have shown good agreement with the theoretical result predicted above, even though the diameter of the test piston was somewhat smaller than the diameter of the central cavity of the test burner to assure free movement of the piston within the cavity, indicating that the effect of a small amount of gas leakage past the piston is negligible.

Because the heat output rate of the burner is directly proportional to the volumetric rate of flow of the combustible gas supplied to the burner, given that the ratio of fuel gas to combustion air in the combustible gas remains constant, then the area over which combustion occurs on the surface of the burner will decrease as the heat output rate of the burner is decreased, and the heat flux level in the combustion zone of the burner will remain constant.

As one skilled in the art will readily apprehend, this embodiment of the invention will operate satisfactorily and give the desired result in a given radiant burner operating at any differential pressure by merely adjusting the weight of the floating gas blocking piston.

Figure 3:
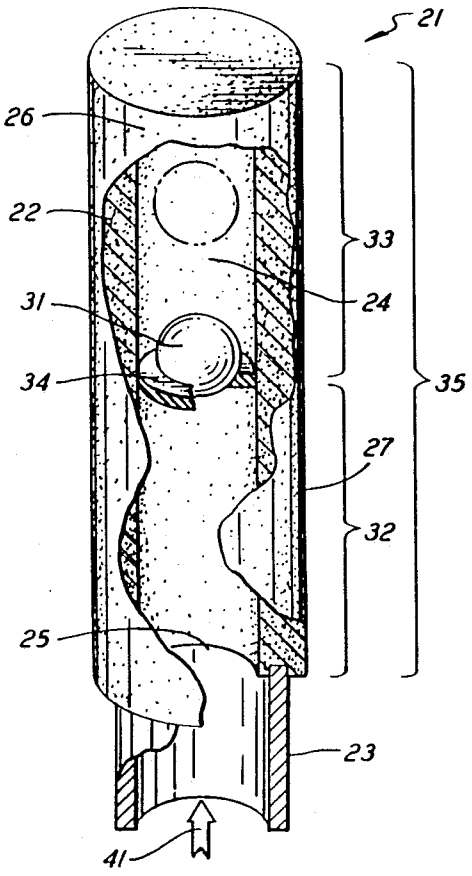
FIG. 3 is a view, partly broken away, of another embodiment of the invention in which the piston rests on a seat until the combustible gas flow rate reaches a predetermined value, at which time the piston lifts, allowing gas to enter the entire volume of the central cavity of the burner.

Another preferred embodiment of the present invention is depicted in FIG. 3. In this embodiment, a cylindrical radiant burner 21 comprises gas permeable wall 22 attached to burner stem 23 and surrounding hollow central cavity 24. As in the embodiment depicted in FIG. 1, combustible gas 41 enters central cavity 24 via combustible gas inlet end 25 of burner 21, while opposite end 26 of burner 21 may be either gas permeable or closed. In this embodiment however, spherical gas blocking piston 31, with a diameter somewhat smaller than the diameter of the central cavity, is positioned above piston seat 34. Below a threshold combustible gas flow rate, piston 31 will rest on piston seat 34, preventing the flow of gas into the volume of central cavity 24 above piston 31 and thus allow combustion on outer surface 27 of burner wall 22 below the level of seat 34, creating combustion zone 32 below and no combustion zone 33 above the level of seat 34. When gas flow rate is increased above the threshold level, blocking piston 31 will lift off piston seat 34, allowing combustible gas to enter the volume of central cavity 24 above piston seat 34 and allowing combustion to take place over the entire outer surface of burner wall 27, creating full fire combustion zone 35.

The embodiment of the present invention depicted in FIG. 3 will allow for somewhat looser tolerances in manufacturing the radiant burner and piston and yet be suitable for use in conjunction with the two-position (high-low) gas regulating valves currently available.

The selection of the material to be used for constructing the gas blocking piston in either of the embodiments described above is not critical, as even in full fire operation, the interior cavity of the burner remains cool. For example, the invention has been tested satisfactorily using a common table tennis ball as the gas blocking piston in a radiant burner of appropriate dimensions. It is important that the dimensions of the piston be such that it slides freely within the central cavity of the burner and yet, in the embodiment depicted in FIG. 1, that the piston block, as completely as possible, the passage of combustible gas from the volume upstream to the volume downstream of the piston. It is also important that the weight of the gas blocking piston be appropriate to the wall differential pressure at which the burner operates.

The embodiments of the invention described and depicted above show a radiant burner that is cylindrical and a gas blocking piston that is spherical. These configurations offer certain manufacturing and operational advantages. One skilled in the art will appreciate that the principles taught by the invention apply equally to a cylindrical burner with a blocking piston having an appropriate circular cross section as well as to a burner of another cross sectional shape coupled with a piston having a configuration appropriate to the burner. A burner may be constructed in accordance with the embodiment depicted in FIG. 3 but having more than one gas blocking piston and piston seat.

One skilled in the art will also appreciate that the embodiments of the invention described and depicted above will only operate when the longitudinal axis of the burner is oriented vertically or nearly so with the combustion gas inlet located below the piston. The principles taught by the invention apply equally well to a burner oriented and configured differently by using appropriate means to displace the gas blocking piston within the burner central cavity proportionately to combustible gas flow rate.

Other embodiments and modifications may occur to one skilled in the art. It is intended, however, that the scope of the invention be limited only by the scope of the below claims.

What is claimed is:

1. In a radiant infrared burner having a combustible gas supply, a gas permeable wall surrounding a central cavity, a combustible gas inlet end and an opposite end, a method for modulating the surface area of said wall on which combustion occurs comprising the steps of:

slideably disposing a gas blocking piston within said cavity; and displacing said gas blocking piston toward said opposite end as the flow rate of said combustible gas supply increases and toward said combustible gas inlet end as the flow rate of said combustible gas supply decreases.

2. The method of claim 1 in which the displacement of said gas blocking piston is proportional to the flow rate of said combustible gas supply.

3. The method of claim 1 further comprising the additional step of:

disposing a piston seat within said central cavity between said gas blocking piston and said combustible gas inlet end against which said piston seat said gas blocking piston rests until the flow rate of said combustible gas supply exceeds a predetermined value.

4. An apparatus for modulating a radiant infrared burner having a combustible gas supply, a gas permeable wall surrounding a central cavity, a combustible gas inlet end and an opposite end comprising a gas blocking piston slideably disposed within said central cavity; and a means to modulate the surface area of said wall on which combustion occurs by displacing said gas blocking piston toward said opposite end as the flow rate of combustible gas supply increases and toward said combustible gas inlet end as the flow rate of said combustible gas supply decreases.

5. The apparatus of claim 4 in which the displacement of said gas blocking piston toward said opposite end is proportional to the flow rate of said combustible gas supply.

6. The apparatus of claim 5 in which said radiant infrared burner and said central cavity are cylindrical, said central cavity is coaxially aligned within said radiant infrared burner and said gas blocking piston is spherical.

7. The apparatus of claim 4 further comprising a piston seat disposed within said central cavity between said gas blocking piston and said combustible gas inlet end against which said piston seat said gas blocking piston rests until the flow rate of said combustible gas supply exceeds a predetermined value.

8. The apparatus of claim 4 in which said radiant infrared burner and said central cavity are circular in cross section, said central cavity is coaxially aligned within said radiant infrared burner and said gas blocking piston is spherical.

* * * * *